US011583866B2

(12) United States Patent
Hail

(10) Patent No.: US 11,583,866 B2
(45) Date of Patent: Feb. 21, 2023

(54) AIR MILL WITH ROTARY DISC ASSEMBLY

(71) Applicant: Nick Hail, Edmond, OK (US)

(72) Inventor: Nick Hail, Edmond, OK (US)

( * ) Notice: Subject to any disclaimer, the term of this patent is extended or adjusted under 35 U.S.C. 154(b) by 253 days.

(21) Appl. No.: 17/007,689

(22) Filed: Aug. 31, 2020

(65) Prior Publication Data

US 2021/0060575 A1 Mar. 4, 2021

Related U.S. Application Data

(60) Provisional application No. 62/894,397, filed on Aug. 30, 2019.

(51) Int. Cl.
*B02C 19/00* (2006.01)

(52) U.S. Cl.
CPC ..... *B02C 19/005* (2013.01)

(58) Field of Classification Search
CPC .. B02C 19/006; B02C 19/0012; B02C 19/005
USPC ..... 241/277
See application file for complete search history.

(56) References Cited

U.S. PATENT DOCUMENTS 130,505 A * 8/1872 Jones ..... B02C 4/06 241/62
197,353 A * 11/1877 Gerdom ..... B02C 13/26 241/85
1,756,253 A * 4/1930 Lykken ..... B02C 23/00 406/135
2,656,868 A * 10/1953 Hintz ..... A01F 29/095 241/55
2,821,344 A * 1/1958 Lykken ..... B02C 23/00 241/39
2,875,956 A * 3/1959 Lykken ..... B02C 19/005 241/82
4,061,276 A * 12/1977 Felker ..... B02C 19/0012 241/284
4,347,986 A * 9/1982 Haddon ..... B02C 19/005 241/74
4,824,031 A * 4/1989 Wiley ..... B02C 19/005 241/39
5,224,656 A * 7/1993 Kobayashi ..... B01F 35/145 241/188.2
5,368,243 A 11/1994 Gold
(Continued)

FOREIGN PATENT DOCUMENTS

WO 2009/123900 A1 10/2009

*Primary Examiner* — Faye Francis
(74) *Attorney, Agent, or Firm* — Hall Estill Law Firm

(57) ABSTRACT

Method and apparatus for fracturing particulates during an air mill process. In some embodiments, a disc assembly is rotated within a housing about a central axis. The disc assembly includes a horizontally extending annular ring with opposing innermost and outermost edge surfaces. A retention flange extends adjacent the outermost edge surface of the annular ring. Spaced apart impellers project from an upper surface of the annular ring for movement in a direction of rotation of the annular ring to form an inner zone of lower pressure surrounded by an outer zone of higher pressure. During air mill processing, an inlet stream of particulates is introduced to the inner zone to induce collisions among previously introduced particulates into the inner zone. Reduced-sized fractured particulates are removed from the inner zone using a negative pressure supplied via a vacuum line.

22 Claims, 8 Drawing Sheets

(56) References Cited

U.S. PATENT DOCUMENTS

| | | | | |
|---|---|---|---|---|
| 6,135,370 | A * | 10/2000 | Arnold | B29B 17/0404 241/1 |
| 6,179,231 | B1 * | 1/2001 | Csendes | B02C 13/18 241/97 |
| 6,227,473 | B1 * | 5/2001 | Arnold | B02C 13/18 241/1 |
| 9,724,700 | B2 | 8/2017 | Farr | |
| 2012/0168541 | A1 * | 7/2012 | Gryaznov | B02C 19/0012 241/65 |
| 2012/0280071 | A1 * | 11/2012 | Manola | B02C 19/0025 241/43 |
| 2021/0339261 | A1 * | 11/2021 | Lutoslawski | B02C 13/26 |

* cited by examiner

AIR MILL WITH ROTARY DISC ASSEMBLY

RELATED APPLICATIONS

The present application makes a claim of domestic priority under 35 U.S.C. 119(e) to U.S. Provisional Patent Application No. 62/894,397 filed Aug. 30, 2019, the contents of which are hereby incorporated by reference.

BACKGROUND

Mills are used to break solid materials down into smaller pieces through grinding, crushing, cutting, pulverizing, fracturing, and/or other mechanical processes that involve the application of kinetic loads to the materials. Milling has historically been applied to a wide variety of materials including grain, ore, rock, soil, timber, textiles, etc.

Some milling processes induce contact between the material and various hardened elements such as grind stones, rollers, balls, blades, plates, etc. in order to impart the necessary compressive and/or shear forces to separate the material along grain boundaries. Other milling processes establish kinetic contact among particles of the material itself, such as in the case of drum mills and air mills. The motive power necessary to activate (e.g., rotate) active components of a mill and thus, impart the necessary separation forces to the material, has been supplied in a variety of ways including through the use of wind, water, livestock, electric motors, gravity, etc.

Regardless of form, a mill is generally designed to reduce the overall particulate size of individual pieces or grains of the inlet material to a desired range. While a wide variety of mill configurations have been proposed and used in the past, there remains a continual need for improvements in the art for the milling of various materials, including but not limited to silica, diamond, titanium carbide, certain nitrides and other particularly hard and/or abrasive materials.

SUMMARY

Various embodiments of the present disclosure are generally directed to an apparatus and method for fracturing particulates during an air mill process.

In some embodiments, rotary milling member has at least one disc assembly that is rotated within a housing about a central axis. The disc assembly includes an annular ring that surrounds the central axis with opposing innermost and outermost edge surfaces. A retention flange extends adjacent the outermost edge surface of the annular ring. Spaced apart impellers project from an upper surface of the annular ring for movement in a direction of rotation of the annular ring to form an inner zone of lower pressure surrounded by an outer zone of higher pressure. During air mill processing, an inlet stream of particulates is introduced to the inner zone to induce collisions among previously introduced particulates into the inner zone. Reduced-sized fractured particulates are removed from the inner zone using a vacuum line.

These and other features and advantages of various embodiments can be understood from a review of the following detailed description in conjunction with the accompanying drawings.

DETAILED DESCRIPTION

Figure 1:
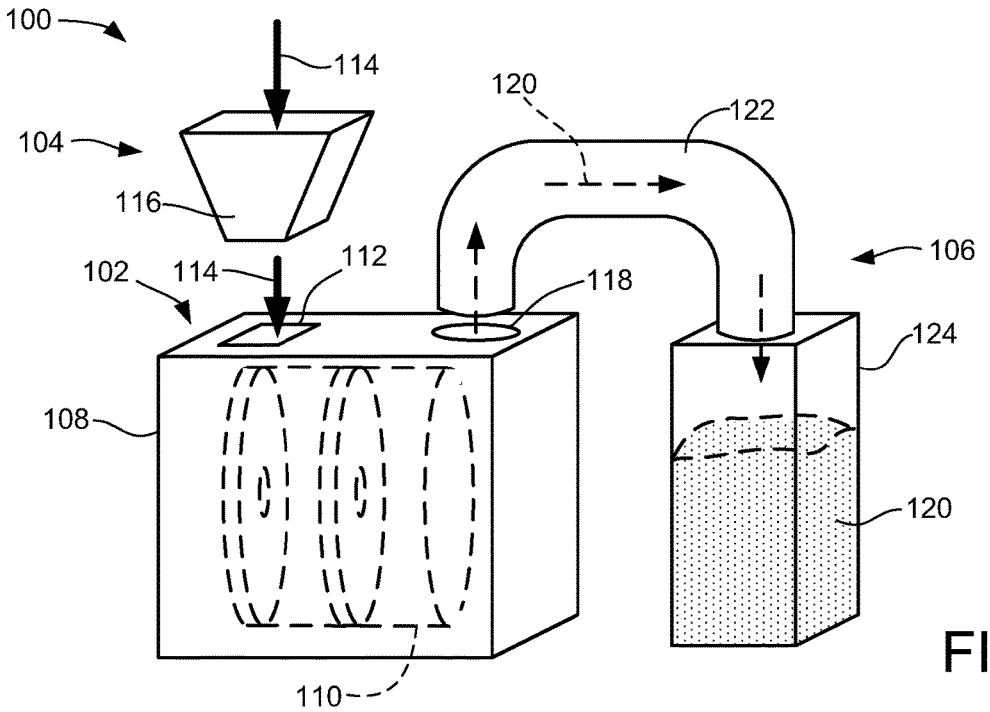
FIG. 1 shows a schematic representation of a rotary mill system constructed and operated in accordance with some embodiments of the present disclosure.

Various embodiments of the present disclosure are generally directed to a rotary mill system configured to perform an air milling process upon a material to reduce a particulate (grain) size of the material to a desired range. Without limitation, the system can be configured to process any number of different types of materials including, without limitation, silica, tungsten carbide, diamond, quartz, metals, etc.

As explained below, the various embodiments operate to grind, pulverize, fracture, etc. particles introduced into the system through inter-particulate collisions. The system generally includes a substantially closed housing in which is disposed a rotary disc assembly (also sometimes referred to as an "impeller assembly"). The disc assembly includes a relatively thin annular ring that circumferentially extends and rotates about a central axis. The ring is oriented in a substantially vertical orientation so that the central axis is nominally horizontal. However, this is merely illustrative and not limiting.

Extending from an upper facing surface of the ring are a plurality of spaced apart fan blades, or impellers. The impellers may be curved or otherwise segmented in a concave fashion in the direction of rotation to induce cyclonic rotation of a volume of air, analogous to a mini-tornado. A sidewall may form an outer boundary for the annular disc and extend upwardly from an outermost diameter (OD) of the disc. A range of possible rotation rates may be imparted to the disc assembly during operation through the use of a variable frequency drive (VFD) to tune the system for processing different sizes and types of materials. In some embodiments, multiple disc assemblies are axially aligned and concurrently rotated to form a rotary mill assembly.

As with tornadoes, the rotation of the disc assembly induces a cyclonic movement of the surrounding air within the housing. This forms a low pressure zone in an interior of the circumferential extent of the assembly and a high pressure zone proximate an outer extent of the assembly. A feeder inlet port or similar facilitates the introduction of a stream of particulates of a first size (e.g., a first average diameter).

As desired, deflection plates are arranged to cause the gravity fed stream to be kinetically diverted into the low pressure zone. Particulates previously introduced into the low pressure zone are accelerated and generally retained within the low pressure zone. This low pressure zone can be viewed as extending across an interior portion, or radial range, of an inner half or so of the spinning disc. The accelerated particles collide with the newly introduced particles to fracture the particulates into progressively smaller sizes.

An outlet assembly includes a vacuum line with a negative pressure (e.g., pressure less than atmospheric pressure) that is fluidly coupled to the low pressure zone. When the particulates become sufficiently small (e.g., reach a second average diameter), the particles are lifted from the low pressure zone through the vacuum line to an external vessel for collection. A set of material may be passed multiple times through the system to progressively reduce the average size, as well as the range of sizes, of the particles.

These and other features and advantages of various embodiments can be understood beginning with a review of FIG. 1 which schematically depicts a rotary mill system 100. The system 100 generally includes a mill 102, an inlet assembly 104 and an outlet assembly 106. The mill 102 includes a substantially closed housing 108 in which a rotary disc assembly 110 is enclosed as described below.

An inlet port 112 extends through the housing 108 to enable the introduction of a flow of material (denoted by arrows 114) into the mill 102 for a pulverizing operation. A hopper 116 can form a portion of the inlet assembly 104 to assist in the directing of the inlet material, although other forms of inlet assemblies can be used as desired.

An outlet port 118 extends through the housing 108 to facilitate the flow of an outlet, pulverized material 120 along a conduit 122 to a receiving container (receptacle) 124. It is contemplated that a vacuum source (not separately shown in FIG. 1) will supply a negative pressure to the conduit 122 to direct the outlet material for collection in the container 124. While conduit 122 is shown to be external to the housing 108, suitable ports and connections may extend into the housing at an appropriate location to receive the outlet particles.

The system 100 is scalable to substantially any appropriate size depending on the throughput requirements of a given application. Without limitation, in some embodiments the system is roughly pallet-sized so as to fit within a relatively small volume, such as about 6 feet (l)×4 feet (w)×5 feet (h) or so. The system is scalable, however, to any suitable size. The system can be staged to operate in successive sections, so that the outlet particles from a first stage are fed to a downstream second stage, and so on. In other embodiments, multiple units can be constructed to operate in parallel. Upstream mills such as ball mills, crush rollers, etc. can be used to apply initial processing and supply the input material at a desired average particle size.

Figure 2:
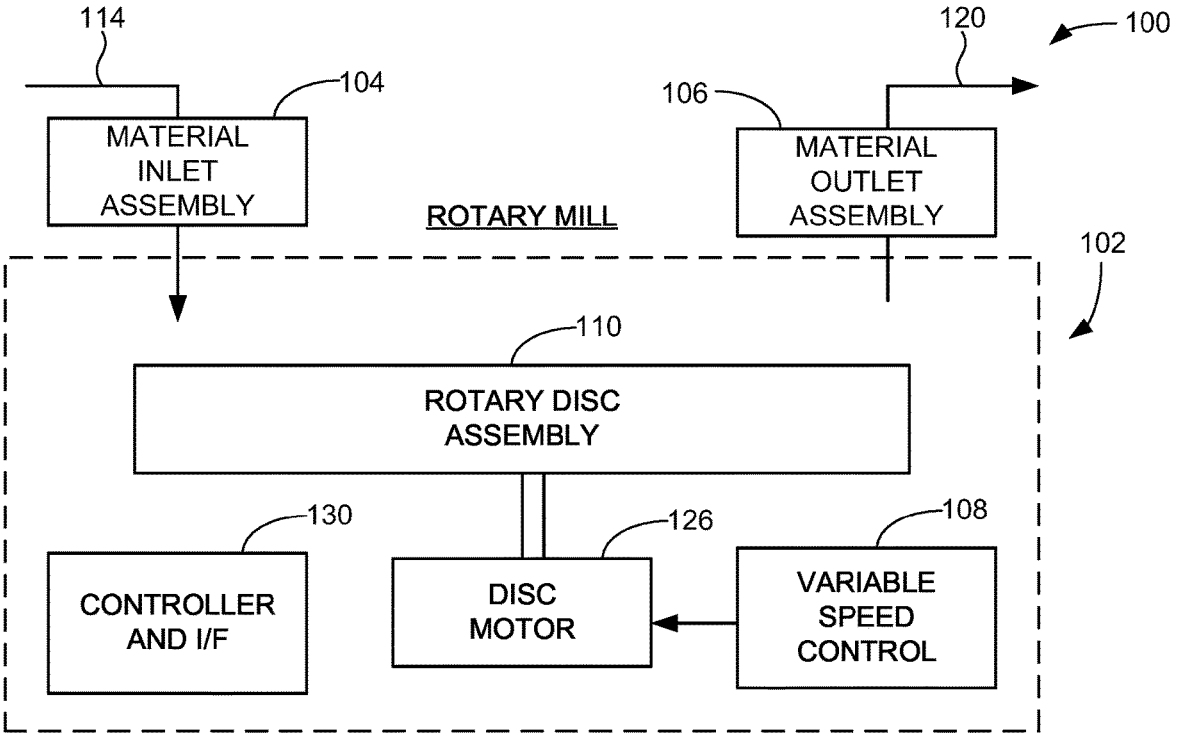
FIG. 2 is a functional block representation of the system of FIG. 1.

FIG. 2 provides a functional block representation of the system 100 in some embodiments. The mill 102 includes the aforementioned rotary disc assembly 110 which is rotated at a selected velocity (speed and direction) by a disc motor 126. For ease of illustration, the disc assembly 110 is depicted along a horizontal orientation, but it will be understood that in practice, the disc assembly may be arranged in a vertical orientation so as to rotate about a horizontal central axis. Other orientations may be used.

A variable frequency drive (VFD) unit 128 can be used to adjust the rotational rate of the disc assembly 110 over a suitable range. Any number of rotational rates can be used, including but not limited to about 3600+/−1000 revolutions per minute (rpm). A controller and interface (I/F) circuit 130 provides user inputs, control and power for the operation of the mill, including setting the rotational speed to the desired value, setting the output vacuum level, etc.

Figure 3A:
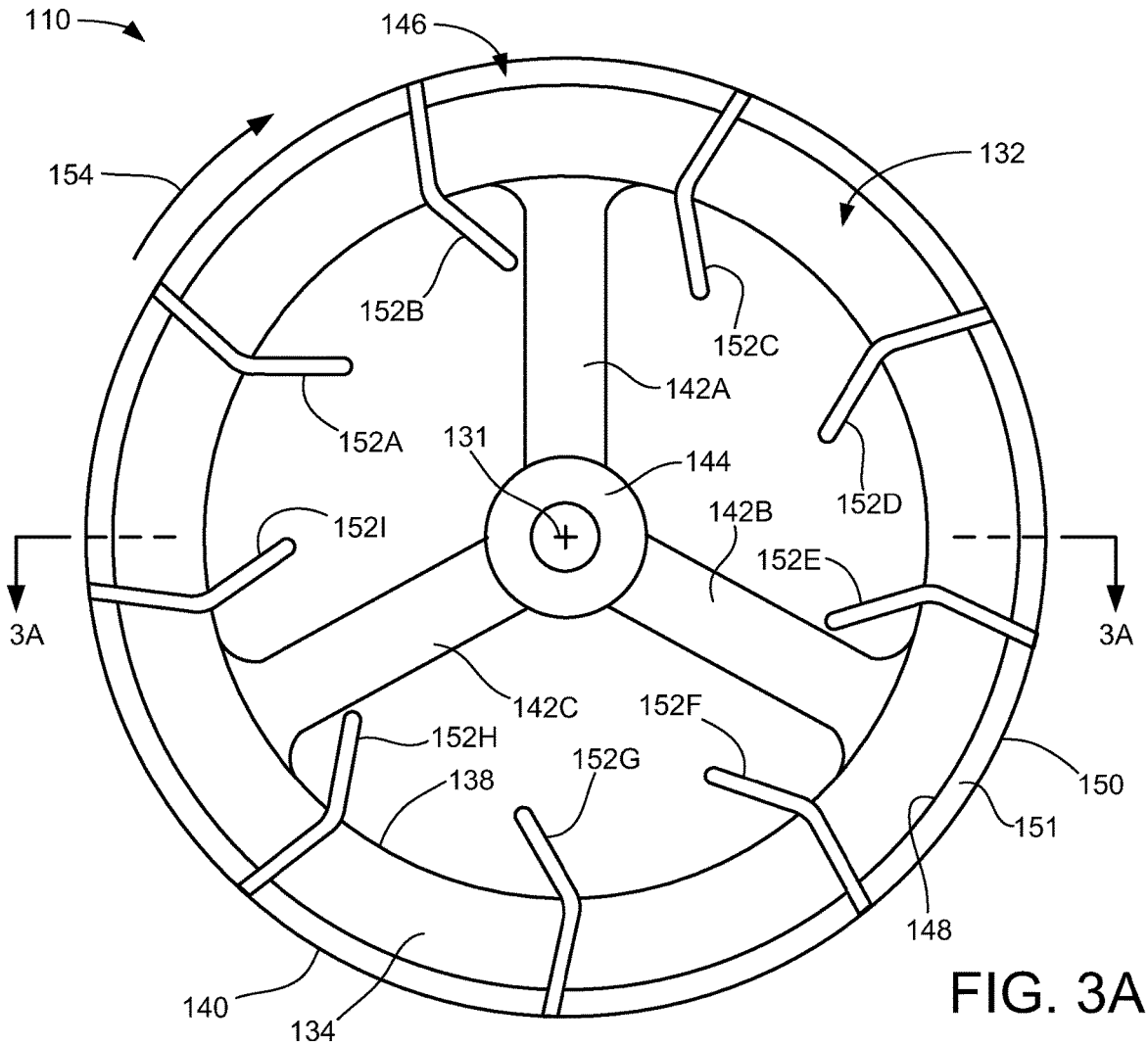
FIG. 3A is a top plan depiction of a rotary disc assembly of the system in some embodiments.
Figure 3B:
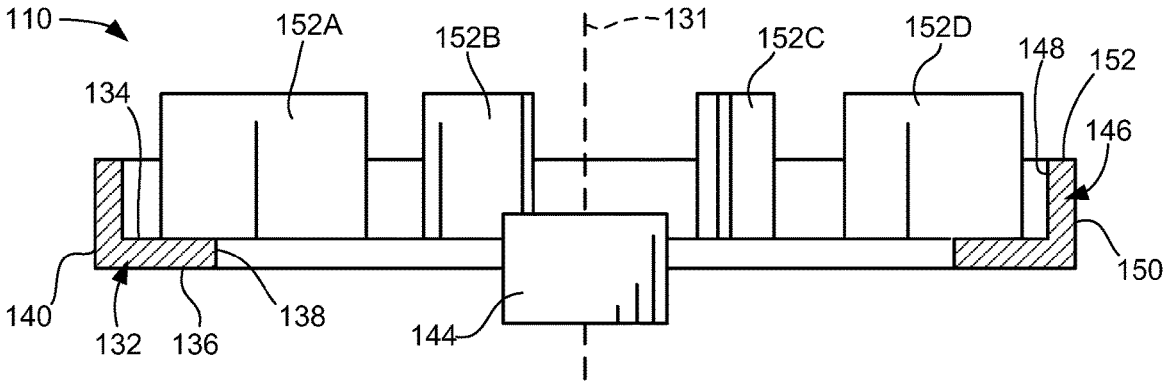
FIG. 3B is an elevational, partial cross-sectional view of the disc assembly as generally viewed along section line 3A-3A.

FIGS. 3A and 3B show respective top plan and side-elevational views of aspects of the rotary disc assembly 110 from FIGS. 1-2 in some embodiments. The disc assembly 110 can be generally characterized as a rotatable impeller that is rotated about a horizontally extending central axis 131.

The disc assembly 110 generally includes an annular disc 132 that circumferentially extends at a selected radial distance from the central axis 131. The disc 132 has opposing top and bottom flat (horizontal) surfaces 134, 136, an innermost annular sidewall 138 and an outermost annular sidewall 140. A number of support flanges (spokes) 142A, 142B and 142C project inwardly from the innermost sidewall 138 to a central hub 144. The hub 144 is configured for attachment to a motor shaft (not separately shown). While three (3) support flanges are depicted, other numbers of flanges can be used as desired. The spokes 142A-C and hub 144 can be coplanar with the annular disc 132, or can be recessed below the disc.

A retention flange 146 extends vertically from an outermost edge of the flat annular disc 132 so that the disc 132 and flange 146 combine to provide a substantially L-shaped cross-section, as best viewed in FIG. 3B. The retention flange 146 includes an innermost sidewall 148 in facing relation to the central axis 131, an outermost sidewall 150 and a top surface 151. It is contemplated albeit not necessarily required that, the outermost sidewall 150 of the retention flange 146 will align with the outermost sidewall 140 of the disc 132.

A total of nine (9) impellers are incorporated into the disc assembly 110, although other numbers of impellers can be used. For clarity, the impellers are separately and individually denoted as 152A, 152B, 152C, 152D, 152E, 152F, 152G, 152H and 152I. Each impeller is respectively supported by the top surface 134 of the annular disc 132 and the inner sidewall 148 of the retention flange 146, and are equally spaced about the circumference of the disc assembly as shown. Each of the impellers is concave so as to curve inwardly in a direction of rotation of the disc assembly, which in this case is clockwise in FIG. 3A as indicated by arrow 154. It is contemplated that a portion of each impeller will extend inwardly beyond the innermost sidewall 136 of the disc 132.

Figure 4A:
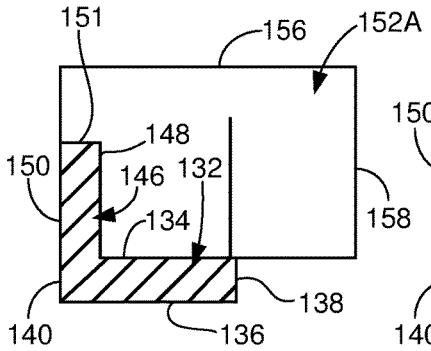
FIGS. 4A through 4C show different alternative configurations for the disc assembly in accordance with various embodiments.
Figure 4B:
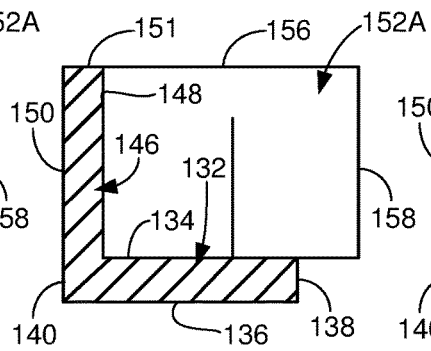
Figure 4C:
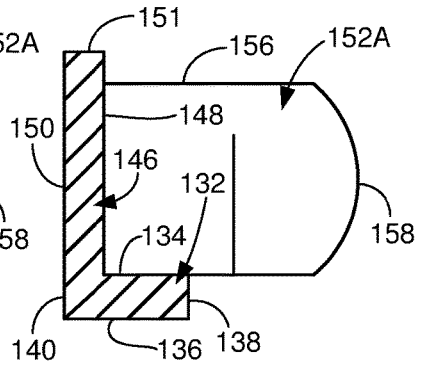

The respective sizes of the disc 132, retention flange 148 and impellers can vary. FIGS. 4A-4C show different example configurations that can be used. Other configurations will readily occur to the skilled artisan in view of the present disclosure.

Figure 3C:
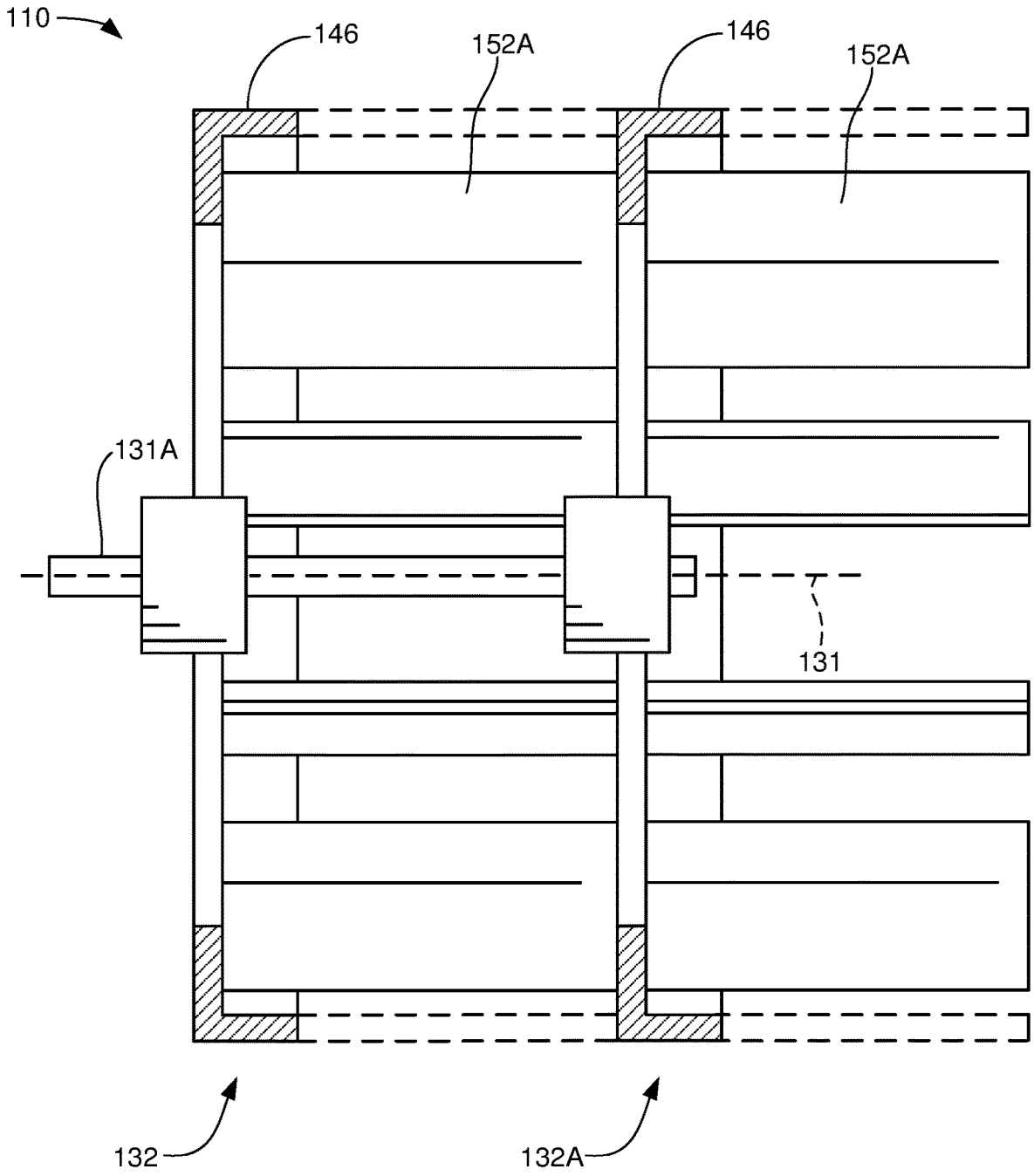
FIG. 3C shows a rotary mill assembly which incorporates two axially aligned disc assemblies in some embodiments.

FIG. 3C shows that multiple disc assemblies 132, 132A can be axially aligned and adjoined to form the mill assembly 110. Each disc assembly is nominally identical, and the impellers 152A-I extend as shown from one disc to the next. As desired, the annular side walk 146 can be extended as well A central shaft 131A is turned by the motor (108, FIG. 2) to rotate the assembly at the desired rotational rate.

FIG. 4A shows a configuration that generally corresponds to that of FIGS. 3A-3B, with the retention flange 146 being shorter than each impeller (in this case, impeller 152A). More particularly, top surface 151 of the retention flange 146 is recessed with respect to a top surface 156 of the impeller 152A.

FIG. 4B shows the retention flange 146 to have substantially the same height as the impeller 152A, and FIG. 4C shows the retention flange to be taller as compared to the impeller. Other variations can be used as well, including wider or narrower discs 132, as depicted in FIGS. 4B and 4C. Similarly, different shapes can be imparted to the impellers including straight impellers (e.g., rather than curved as in FIG. 3A), curved edges rather than substantially rectilinear edges such as depicted in FIG. 4C, etc. Regardless of these and other configuration variations, it is contemplated that the impeller will project inwardly at least a portion beyond the disc 132; that is, inward impeller surface 158 will be closer to the central axis 131 (FIG. 3B) as compared to the innermost sidewall 138 of the ring 132. In some embodiments, the ratio of the radial extent of the disc 132 to the radial extent of the impellers 152A-I may be from about 20% to about 80%, with a ratio of about 50% being shown in FIGS. 3A-4A.

Figure 5:
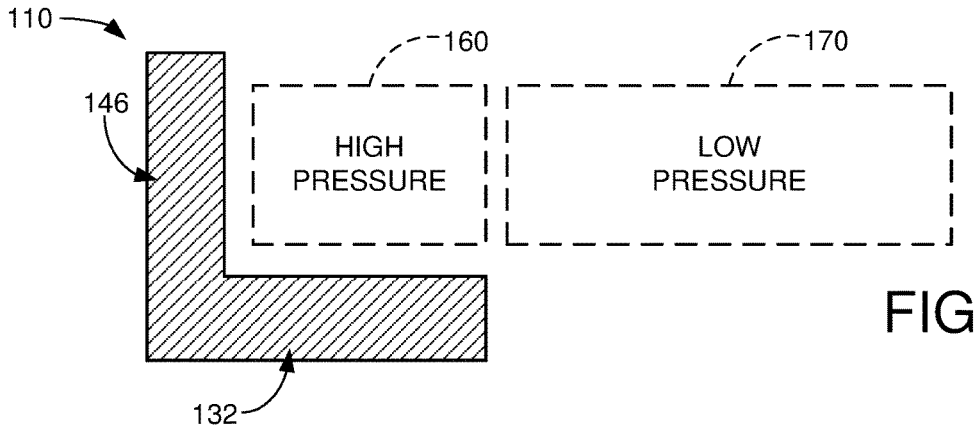
FIG. 5 depicts different pressure zones of atmospheric pressure established by rotation of the disc assembly.
Figure 6:
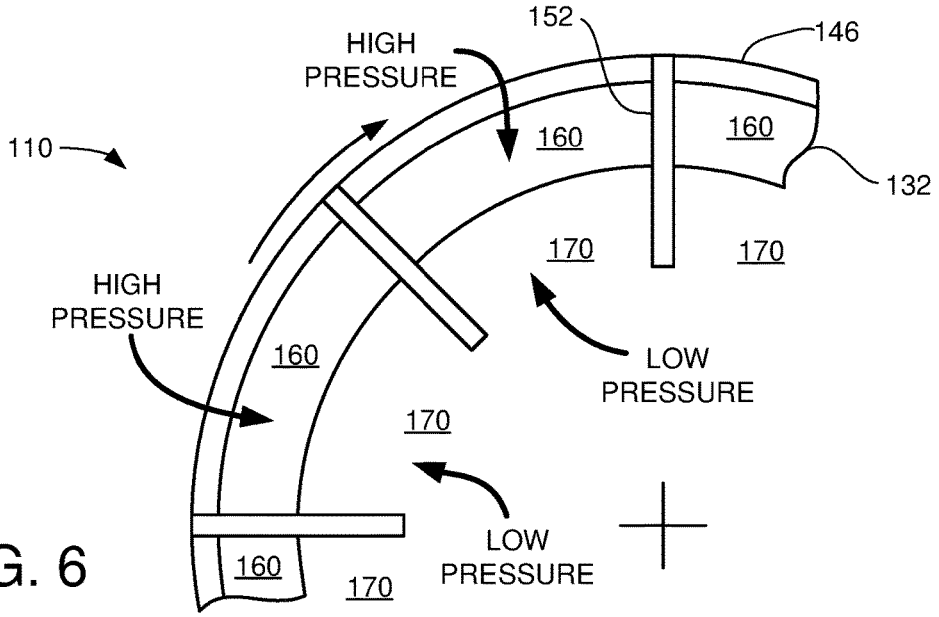
FIG. 6 depicts the pressure zones relative to the disc assembly in some embodiments.

FIG. 5 is a schematic depiction of respective high pressure and low pressure zones 160, 170 that are established by the high speed rotation of the disc assembly 110. As further shown in FIG. 6, the high pressure zones 160 are established substantially along the ring assembly within the recesses bounded by the ring 132, the retention flange 146 and each pair of adjacent impellers (denoted generally at 152). The low pressure zones 170 are nested within the high pressure zones 160 in a direction toward the central axis 131 (FIG. 3B), and include the areas between the adjacent impellers inward of the ring 132 as well as at least a portion of the ring assembly inward of the impellers.

Figure 7:
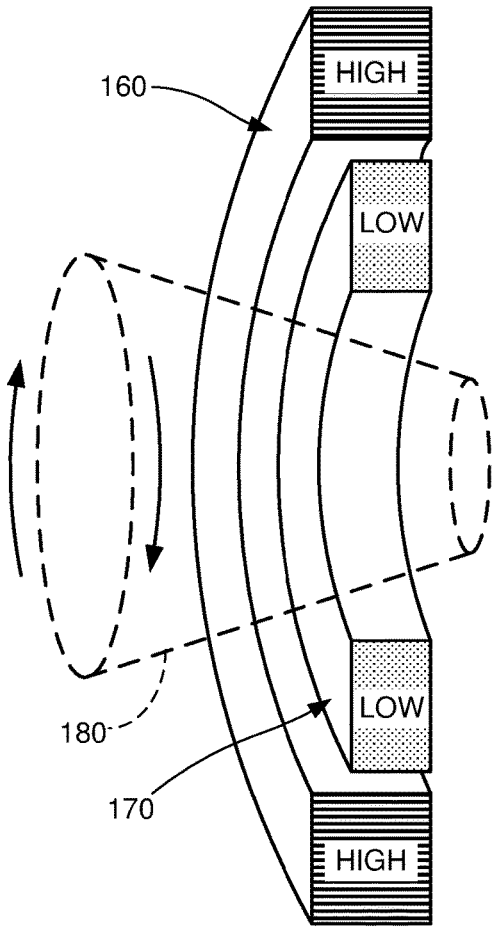
FIG. 7 is another schematic view of the concentric nature of the respective pressure zones.

FIG. 7 is another schematic depiction of the respective high and low pressure zones 160, 170. As discussed above, the disc assembly 110 is configured to generally induce a cyclonic movement of air, as generally depicted at 180, with characteristically high pressure established toward the outermost bounds of rotation and low pressure established toward the center of the cyclonic mass. While the respective high and low pressure zones are shown as distinct regions, it will be appreciated that there will be some gradient between these two areas rather than a step-function drop in pressure as might be otherwise interpreted by the diagram. Nevertheless, a significant drop in pressure will be present in transitioning from the high pressure zone to the low pressure zone. The low pressure zone may extend above and/or below the high pressure zone.

Inlet material (such as 114, FIG. 1) is introduced as a stream of particulates that follow the direction of rotation of the disc assembly 110. The particulates are carried along by the rotational movement of the disc assembly and are substantially retained within the respective high and low pressure zones. In some cases, the material may be introduced near the base of the shaft 131 (FIG. 3C) between the lowermost disc and the motor to allow the material to travel through the mill assembly (left to right in FIG. 3C).

Figure 8A:
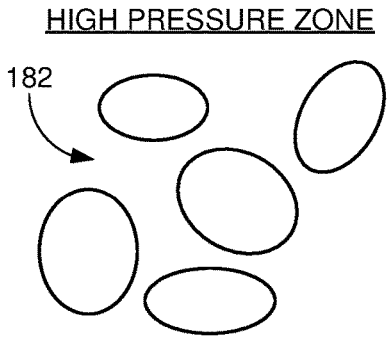
FIGS. 8A and 8B respectively depict various particulates that may tend to aggregate in the respective pressure zones.

Relatively larger diameter particles will tend to migrate toward the high pressure zone, such as generally represented at 190 in FIG. 8A. This general aggregation of the relatively larger particles in the stream in the higher pressure region will occur including based on centripedal forces imparted to the particles by the rotational movement of the disc assembly. The larger mass of the particles 190 will tend to enable the particles to overcome the relatively higher pressure of the outer pressure zone 160 that would otherwise urge the particles toward the low pressure zone 170.

Figure 8B:
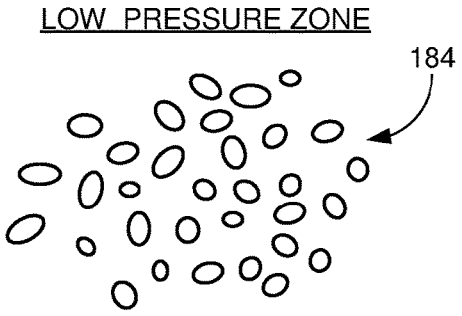

Relatively smaller diameter particles in the stream will tend to migrate to and aggregate in the low pressure zone 170, as generally indicated at 184 in FIG. 8B. The relative sizes and shapes of the respective particles 182, 184 will be understood as being merely representative in nature and are not limiting.

Figure 9:
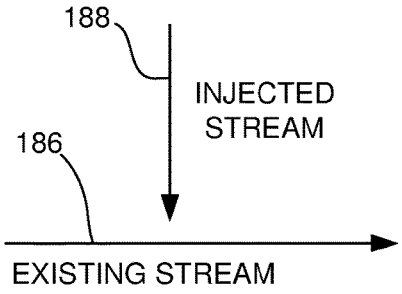
FIG. 9 is a schematic representation of a flow of material through the system in some embodiments.

During operation of the rotary mill 102, new material is continuously injected as a new, or injected stream that intersects or otherwise impacts the existing stream. These respective operations are diagrammatically represented in FIG. 9, with the existing stream denoted by arrow 186 and the injected stream denoted by arrow 188. While the material can be thought of as a single continuous stream, at any given point in time during such operation, newly injected material (e.g., 188) will encounter existing material already present within the system (e.g., 186), hence the characterization of separate streams.

While not necessarily limiting, the newly injected material will tend to have a relatively large size and mass and a relatively low velocity. The existing material will tend to have a relatively smaller size and mass and a relatively high velocity.

The new material in the injected stream 188 will kinetically interact with the existing material of the existing stream 186 to induce fracturing of the particulates. Each collision will induce one or more new, smaller particulates which move off in various directions at high velocity, albeit governed by the direction of rotation, which will spur successive fracturing between the particles.

While some amount of fracturing may occur as a result of incidental kinetic contact between the particles and the various surfaces of the disc assembly 110 (e.g., disc 132, retention flange 148, impellers 152, etc.), the vast majority of the fracturing will occur through inter-particulate collisions, providing an air mill style of operation. As the particles continue to collide with each other, the overall average size of the particles will tend to continuously decrease, as generally represented by curve 190 in FIG. 10. The curve 190 generally represents the decrease in particulate diameter as a function of dwell time.

Figure 10:
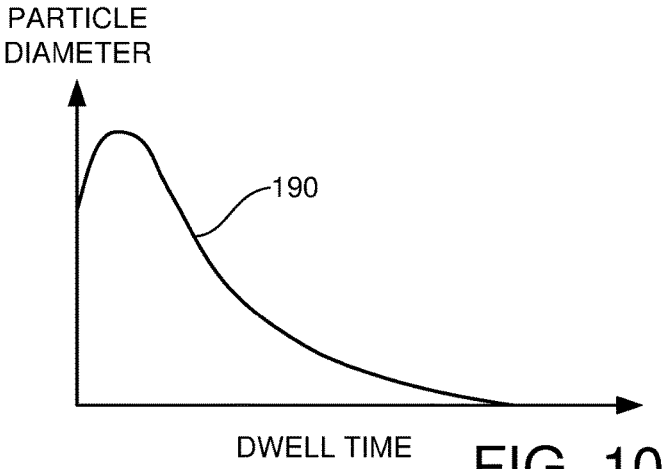
FIG. 10 graphically represents a typical reduction in average particle size (diameter) as a function of elapsed dwell time within the system.

From FIG. 10 it can be observed that, the longer the material continues to collide within the air mill, the smaller the average particle size will become. This is particularly true when a substantially homogenous material is used. Since each particle in such a material has essentially the same hardness and other physical properties, the material will tend to fracture against itself irrespective of how hard the material actually is. As a result, a system constructed in accordance with the present disclosure has been found operative in grinding any number of different substances including diamond, gypsum, silica, etc. to significantly reduced average grain sizes.

Non-homogenous materials can be processed as well, including materials that include heavier ores (e.g., gold) and lighter materials (e.g., quartz, etc.). Significant amounts of gold flakes, for example, have been separated and accumulated within the high pressure zones and retained within the recesses of the disc assembly, while lower density rock and soil have been pulverized and migrated to the lower pressure regions for removal.

Figure 11:
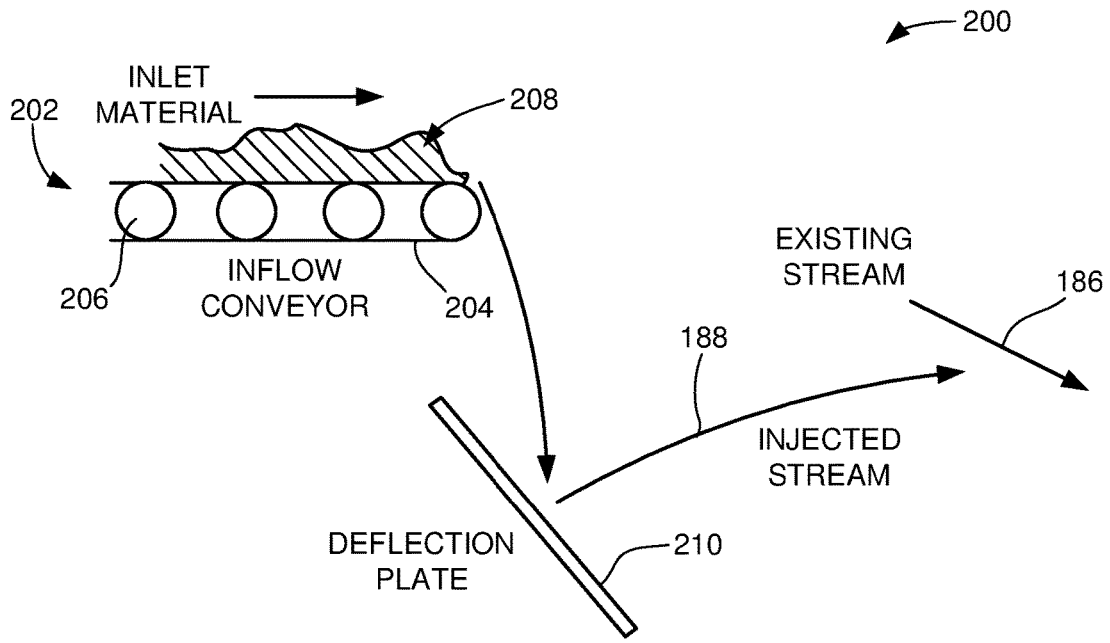
FIG. 11 is a schematic depiction of aspects of an inlet portion of the system in accordance with some embodiments.

FIG. 11 shows a schematic diagram for a material inlet assembly 200 generally corresponding to the inlet system 104 of FIG. 1 in further embodiments. FIG. 11 is merely exemplary and is not limiting, as various other configurations can be used as desired. The system 200 includes an inflow conveyor 202 comprising a flexible belt 204 or similar member routed over a series of rollers 206.

The conveyor 202 transports inlet material 208 (represented as aggregate accumulated and resting on the belt 204) to an end thereof at which point the aggregate material drops, through the operation of gravity, onto a deflection plate 210. The deflection plate 210 may be disposed below or to the side of the rotating disc assembly 110. The plate is configured to deflect the falling material into the existing stream at a desired angle and velocity to initiate the fracturing process. The deflection plate may be adjacent the motor shaft 131 (FIG. 3C) and may be stationary to allow the material to kinetically deflect into the airstream. In other embodiments, the deflection plate may be a series of plates that are affixed to the shaft and rotate, so that contact with the plates slings the material into the mill assembly. Other configurations can be used as desired.

Figure 12:
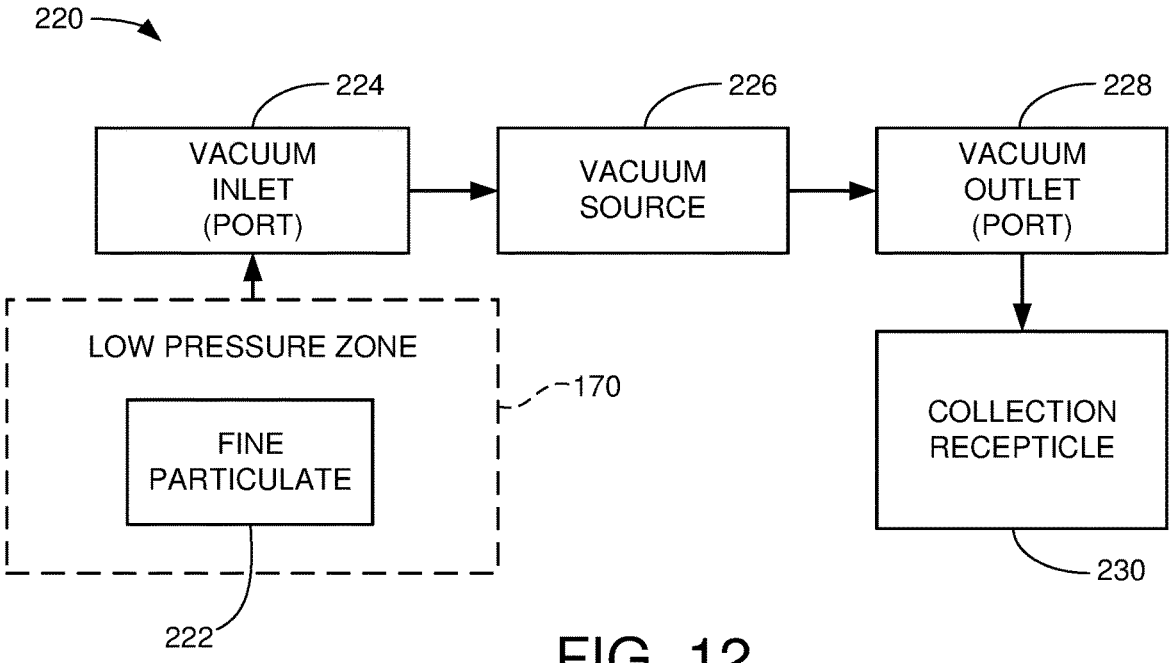
FIG. 12 is a functional block depiction of aspects of an outlet portion of the system in accordance with some embodiments.

FIG. 12 shows a functional block diagram for a material outlet assembly 220 generally corresponding to the outlet system 106 of FIG. 1 in further embodiments. As before, FIG. 12 is merely exemplary and is not limiting.

At some point during the fracturing process, a population of particulates will have achieved a reduced size of sufficiently small diameter and mass as to be able to be removed from the system. These particulates are identified as fine particulates 222 in FIG. 12, and will substantially be carried along by the cyclonic currents of the low pressure zone 170.

Coupled to the low pressure zone 170 is a vacuum inlet, or vacuum port 224, which is in fluidic connection with and applies a negative pressure to the low pressure zone. The pressure and flow rate will be established based on a number of factors such as the amount of negative pressure (vacuum) supplied by a vacuum source 226, which may be adjustable. Other factors may include the various sizes and pressure losses of the conduit and other elements of the passageway set forth to evacuate the fine particulate 222. It is contemplated that the vacuum inlet will be positioned in such a way that sufficiently small particulates will be drawn from the low pressure zone into the port for removal from the mill.

The transferred particulates will pass along to a vacuum outlet port 228 and be blown or otherwise deposited into a collection receptacle 230 (similar to the element 124 in FIG. 1). This can include a bag, a bin, a storage vessel, etc. It is contemplated that the particulates collected in the receptacle will be a fine dust. Average sizes of various materials have provided grain sizes in the range of tens of micrometers, um ($10^{-6}$ meters) or less, providing a significant improvement over the art.

Figure 13:
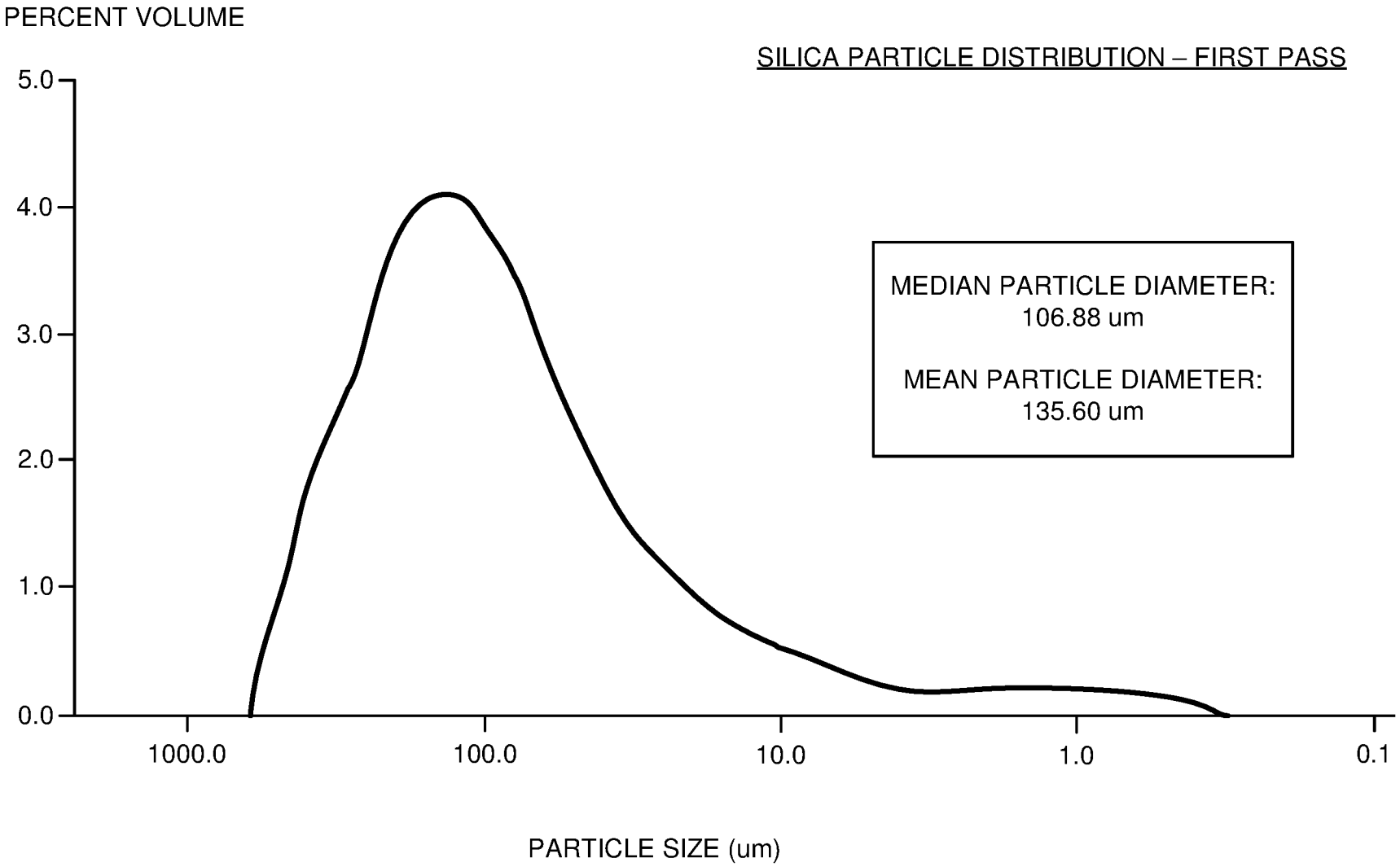
FIG. 13 is a graphical representation of particulate size test results from a first pass of a volume of silica processed using the system of FIG. 1.

FIG. 13 shows a graphical representation of a distribution curve 250 for a population of silica granules that were pulverized using a system corresponding to the air mill system 100 of FIG. 1. The curve 250 is plotted against a logarithmic x-axis 252 and a percent volume y-axis 254. The curve represents particulate data measured using a Beckman Coulter Laser Particle Size Analyzer, Model LS13320. A population of silica particles were measured after having been run through a first pass through the system. The inlet silica was the size of coarse sand grains.

The maximum sized particle located in this first run had a measured diameter of 449.7 micrometers, um ($449.7\times10^{-6}$ m). The median particle size was 106.88 um, and the mean particle size was 135.60 um.

Figure 14:
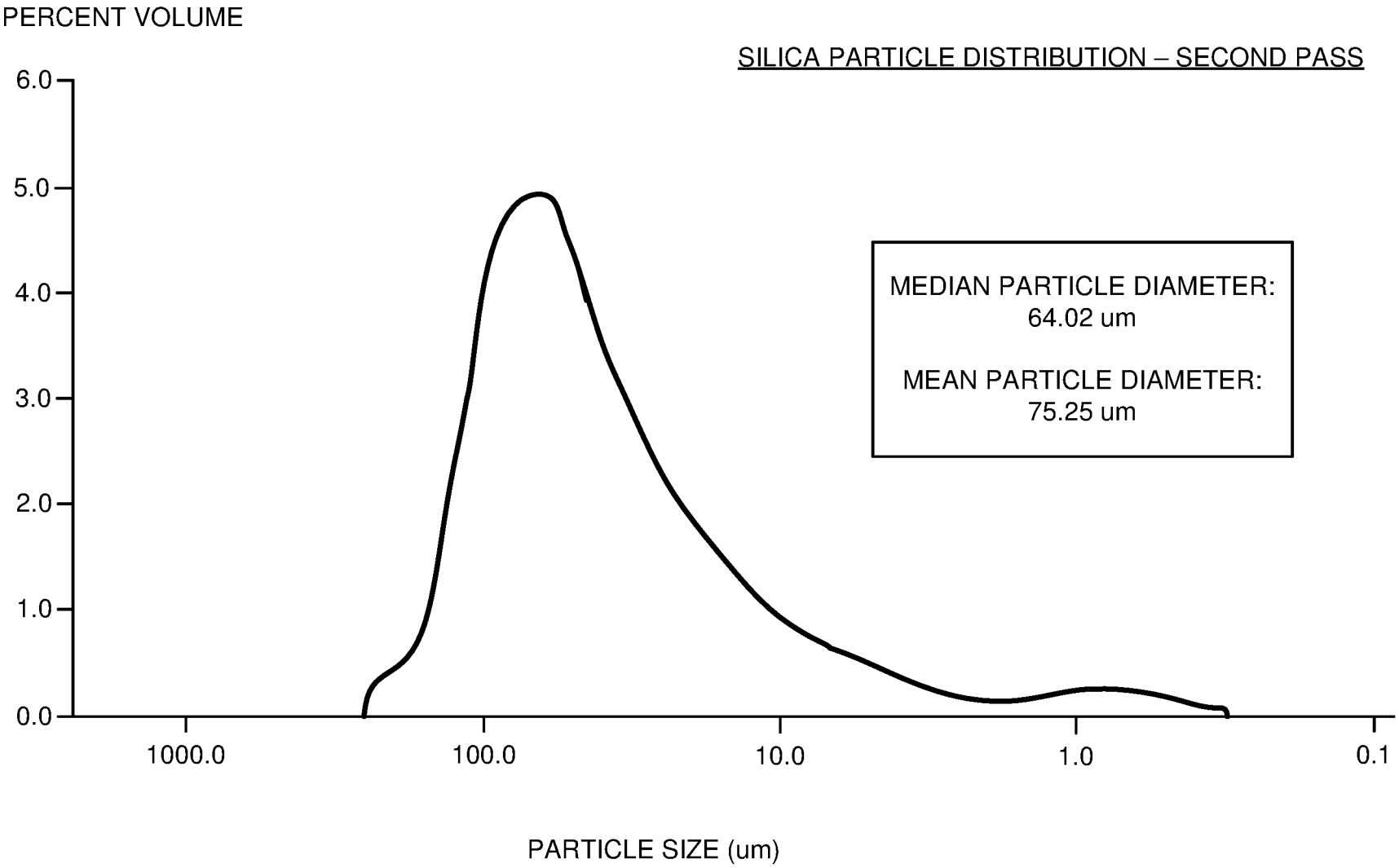
FIG. 14 is a graphical representation of particulate size test results from a second pass of the volume of silica processed using the system of FIG. 1

FIG. 14 shows a graphical representation of a second distribution curve 260, plotted against a corresponding logarithmic x-axis 262 and percent volume y-axis 264. The processed particles from FIG. 14 were reintroduced through the system of FIG. 1 a second time. Further reductions in particulate size were observed. The maximum sized particle in this second run was 234.1 um. The median particle size was reduced to 64.02 um, and the mean particle diameter was reduced to 75.25 um. It is not necessary to make multiple passes, but such can be carried out as desired to achieve a final desired distribution.

The pulverization of particulates provided by the various embodiments presented herein can present a number of benefits over the existing art. Substantially any type of material can be fractured using the process. Because the collisions are essentially limited to inter-particle collisions, little or no wear or damage is incurred within the interior of the mill housing. The cyclonic airflow along with the configuration of the disc assembly, including the retention flange, is sufficient to substantially retain the particulates within the interior vortex area.

The vacuum exhaust provides an effective mechanism for withdrawing material; particulates will continue to remain within the mill only until such time that the particles will have reached a small enough size to be extracted from the low pressure zone. Adjustments in the negative pressure and flow can be made to optimize extraction for a particular range of particulate sizes.

The resulting powder has the consistency of talc or confectionary sugar or finer, and can be used in any number of industrial applications. One such application involves the addition of the particulates to concrete. In one test, the addition of such particulates provided a sample of concrete with significantly higher load bearing capabilities, to the point of becoming ballistic resistant concrete (e.g., significantly greater than 5000 psi compressive strength). Other uses are envisioned and will occur to the skilled artisan in view of the present disclosure.

It is to be understood that even though numerous characteristics and advantages of various embodiments of the present disclosure have been set forth in the foregoing description, together with details of the structure and function of various thereof, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. An apparatus comprising:

an enclosed housing;

a rotatable disc assembly configured for rotation within the housing about a central axis, the rotatable disc assembly comprising:

a horizontally extending annular ring having an innermost edge surface at a first radius with respect to the central axis and an outermost edge surface at a greater second radius with respect to the central axis;

a retention flange coupled to the annular ring adjacent the outermost edge surface of the annular ring; and a plurality of spaced apart impellers that project from an upper surface of the annular ring for movement in a direction of rotation of the annular ring to form an inner zone of lower pressure surrounded by an outer zone of higher pressure;

an inlet assembly configured to distribute an inlet stream of particulates to the inner zone to induce collisions among previously introduced particulates into the inner zone; and an outlet assembly configured to remove, using a vacuum line, particulates from the inner zone having a selected reduced size.

2. The apparatus of claim 1, wherein the outer zone of higher pressure extends between adjacent pairs of the impellers and is bounded within the extending retention flange, and the inner zone of lower pressure extends radially inwardly from the innermost edge surface of the annular ring.

3. The apparatus of claim 1, wherein the extending retention flange extends from the annular disc to a first height, and each of the impellers extends from the annular disc a second height greater than the first height.

4. The apparatus of claim 1, wherein each of the impellers has an impeller outermost edge surface coupled to the retention flange, and an impeller innermost edge surface that extends beyond the innermost edge surface of the annular ring in a direction toward the central axis.

5. The apparatus of claim 1, wherein the annular ring has a radial extent in a direction toward the central axis that is about 50% of a radial extent of each of the impellers in a direction toward the central axis.

6. The apparatus of claim 1, wherein the annular ring has a radial extent in a direction toward the central axis that is from about 20% to about 80% of a radial extent of each of the impellers in a direction toward the central axis.

7. The apparatus of claim 1, wherein the rotatable disc assembly further comprises a central hub mounted to an electric motor for rotation about the central axis, the central hub supporting the annular ring using a plurality of spaced apart, radially extending spokes.

8. The apparatus of claim 1, wherein the rotatable disc assembly comprises a total of three spokes and nine fan blades.

9. The apparatus of claim 1, wherein each of the impellers is concave with respect to the direction of rotation.

10. The apparatus of claim 1, wherein each impeller has an outermost edge surface aligned with the outermost edge surface of the annular ring, and an impeller innermost edge surface which projects inwardly of the innermost edge surface of the annular ring to a third radius less than the first radius.

11. The apparatus of claim 1, further comprising an electric motor adapted to rotate the annular disc and a variable speed control circuit configured to adjust a rate of rotation of the annular disc by the electric motor over a selected frequency range.

12. The apparatus of claim 1, farther comprising a deflection plate disposed at an angle with respect to a horizontal plane in which the annular disc rotates, the deflection plate configured to kinetically deflect the inlet stream of particulates into the inner zone to induce collisions among previously introduced particulates within the housing.

13. The apparatus of claim 1, wherein the outlet assembly comprises a vacuum port in fluidic communication with the inner zone and a vacuum source which applies a negative pressure through the vacuum port to remove and transport the particulates from the inner zone having the selected reduced size along a conduit.

14. A rotatable disc assembly for an air mill to pulverize inlet particulates, the disc assembly comprising:

an annular ring having a top surface, a bottom surface, an innermost edge surface at a first radius with respect to a central axis and an outermost edge surface at a greater second radius with respect to the central axis;

a retention flange coupled to the annular ring adjacent the outermost edge surface of the annular ring and extending from the top surface of the annular ring; and a plurality of spaced apart impellers that project from the top surface of the annular ring, the impellers configured to form an inner zone of lower pressure surrounded by an outer zone of higher pressure responsive to high speed rotation of the annular ring during a pulverizing operation in which the inlet particulates are introduced adjacent the annular ring.

15. The disc assembly of claim 14, wherein the retention flange extends in a direction substantially orthogonal to the top surface of the annular ring.

16. The disc assembly of claim 14, wherein the impellers project from the top surface of the annular ring in a direction substantially orthogonal to the top surface of the annular ring, the impellers configured to form the inner zone of lower pressure radially inwardly of the annular ring.

17. The disc assembly of claim 14, wherein the annular ring has a radial extent in a direction toward the central axis that is about 50% of a radial extent of each of the impellers in a direction toward the central axis.

18. The disc assembly of claim 14, wherein the annular ring has a radial extent in a direction toward the central axis that is from about 20% to about 80% of a radial extent of each of the impellers in a direction toward the central axis.

19. The disc assembly of claim 14, further comprising a central hub aligned with the central axis and at least one radially extending spoke that interconnects the central hub to the annular ring.

20. A method for pulverizing an inlet stream of particulates, comprising:

providing a disc assembly comprising an annular ring having a top surface, a bottom surface, an innermost edge surface at a first radius with respect to a central axis and an outermost edge surface at a greater second radius with respect to the central axis, the disc assembly further comprising a retention flange coupled to the annular ring adjacent the outermost edge surface of the annular ring and extending from the top surface of the annular ring, the disc assembly further comprising a plurality of spaced apart impellers that project from the top surface of the annular ring;

rotating the disc assembly about the central axis so that the impellers form an inner zone of lower pressure surrounded by an outer zone of higher pressure responsive to the rotation of the disc assembly at a selected rotational rate;

injecting the inlet stream of particulates adjacent a first end of the rotating disc assembly to collide with a previously injected stream of particulates carried along the inner zone of lower pressure to introduce inter-particulate collisions and fracturing of the particulates in the respective inlet and previously injected streams; and removing an outlet stream of fractured particulates from the inner zone of lower pressure adjacent an opposing, second end of the rotating disc assembly using a vacuum line fluidically coupled to the inner zone.

21. The method of claim 20, further comprising using an electric motor to rotate the disc assembly about the central axis at the selected rotational rate.

22. The method of claim 20, further comprising using a vacuum source to apply a negative vacuum pressure to the vacuum line to remove the outlet stream of fractured particulates.

* * * * *